US005862597A

United States Patent [19]

Juros

[11] Patent Number: 5,862,597

[45] Date of Patent: Jan. 26, 1999

[54] SUPER BOLT CUTTER

[76] Inventor: Karel B. F. Juros, 14007 Palawan Way #205, Marina de Rey, Calif. 90292

[21] Appl. No.: 796,463

[22] Filed: Feb. 10, 1997

[51] Int. Cl.[6] ..... B26B 17/02

[52] U.S. Cl. ..... 30/191; 30/186

[58] Field of Search ..... 30/175, 176, 179, 30/186, 187, 191, 192

[56] References Cited

U.S. PATENT DOCUMENTS

| | | | |
|---|---|---|---|
| 318,525 | 5/1885 | Vinton | 30/186 |
| 385,139 | 6/1888 | Robinson | 30/186 |
| 1,076,667 | 10/1913 | Farrington | 30/191 |
| 1,159,641 | 11/1915 | Bernard | 30/191 |
| 2,548,422 | 4/1951 | Cronk | 30/186 |
| 2,745,177 | 5/1956 | Kortick | 30/186 |
| 4,198,749 | 4/1980 | Nordin | 30/192 |

*Primary Examiner*—Hwei-Siu Payer
*Attorney, Agent, or Firm*—Norton R. Townsley

[57] ABSTRACT

A mechanical cutter for cutting solid materials. It comprises left and right cutting jaws which are moveably connected by a rear hardware unit and rotate about this pivot point. The cutting jaws have opposing curved cutting edges which close but form an opening extending down to the base. The cutting jaws also have central holes. Straps with two mounting holes and an elongated base hole are placed above and below the cutting jaws to guide the linear motion of the cutting jaws. One pair of handle plates is placed above the top strap and another pair of handle plates is placed below the bottom strap. Alternately, a handle assembly is slid over the straps on the right and left side. A circular boss with an eccentric hole is on the end of each top and bottom handle plate. The circular bosses mate with the respective strap mounting holes. The plates are connected with each other through, the eccentric holes in the circular bosses and the central holes in the cutting jaws, by front hardware units. Two handles are each formed by assembly of one bottom plate to one respective top plate. The handles have grips which assist in keeping the handle plates joined. As the handles are separated, the jaws open to allow the material to be cut to enter. As the handles are closed, the cutting edges of the jaws close and cut the inserted material.

21 Claims, 5 Drawing Sheets

SUPER BOLT CUTTER

BACKGROUND OF THE INVENTION

The applicant claims the benefit of his provisional application, Ser. No. 60/025,824, filed Sep. 3, 1996.

The present invention relates to the field of mechanical tools and more particularly tools used for cutting solid, roughly circular materials such as bolts.

The standard bolt cutter is generally made up of two handles connected to a pair of opposing jaws which can be manually separated or brought together by movement of the handles. The connection of the handles to the jaw can be designed to create double action movement which produces greater cutting force. Single action bolt cutters which provide reduced cutting power are also available on the market.

The current state of the art for mechanical bolt cutters generally requires five sizes of cutters to cut steel bolts with a diameter of up to ⅝". This results in the necessity to make and stock many component parts and finally assembled products which increases the cost of bringing the product to market. Further, the state of the art bolt cutters are heavy, relatively expensive to manufacture, and the handles must be made long enough to exert sufficient cutting force. The cutting force in the state of the art bolt cutters is also hindered by the fact the application of cutting force only occurs through a small portion of the handle arc range.

Development of a bolt cutter which has greater cutting power but which can be made lighter, shorter, and less expensively than products presently on the market represents a great improvement in the field of bolt cutters and satisfies a long felt need in the construction industry as well as for other mechanics and home craftsmen.

SUMMARY OF THE INVENTION

The present invention is a mechanical tool used for cutting bolts and similar items. The preferred embodiment of this invention comprises two jaws, two straps, two handles each comprised of two plates and two grips, and attaching hardware. The cutting jaws are moveably connected by a rear hardware unit and rotate about this pivot point. The cutting jaws have opposing curved or angled cutting edges which close but form a radial-shaped opening extending down to the cutting edge base. The cutting jaws also have central holes.

A strap with two mounting holes and an elongated base hole is placed above and below the cutting jaws and serve to guide the linear motion of the cutting jaws. Alternately, an assembly which is formed of two, spaced apart straps is placed around the cutting jaws. One pair of handle plates is placed above the top strap and another pair of handle plates is placed below the bottom strap. Alternately, the pairs of handle plates on each side of the invention can be formed as an assembly. A boss with an eccentric through hole is on the end of each top and bottom handle plate. The bosses mate with the respective strap mounting holes and are connected with each other through, the eccentric holes in the bosses and the central holes in the cutting jaws, by front hardware units. The plates one side are mirror images of the plates on the other side and the top plates are identical to the bottom plates except in reverse position. Two handles are each formed by assembly of one bottom plate to one respective top plate. The handles have grips which assist in keeping the handle plates joined. The gaps between the plates can be filled by a variety of means, such as shaping of the plates, attachment of filler strips or formation of an integral filler in the grips.

As the handles are separated, the jaws open to allow the material to be cut to enter. As the handles are brought close together, the cutting edges of the jaws close and cut the inserted material.

The present invention overcomes the deficiencies of presently available cutting tools by providing more cutting power with a design which is lighter, shorter, and less expensive to manufacture. Presently available bolt cutters generally come in five sizes. These state of the art bolt cutters are heavy, relatively expensive to manufacture, and the handles must be made long enough to exert sufficient cutting force. Bolt cutters currently on the market limit application of the cutting force to only a small portion of the handle arc range thereby further reducing the cutting effectiveness.

The present invention overcomes these deficiencies. With only two cutter sizes, the present invention provides the same cutting capacity as the five cutter sizes currently available on the market. The design of the present invention allows for a lighter and shorter tool without sacrificing cutting force. Further, the cutting jaws have opposing cutting edges which close at the cutting tips, but form a radial-shaped opening extending down to the cutting edge base which results in added cutting effectiveness. Finally, the unique design of the present invention allows cutting force to be applied over most of the handle motion arc resulting in easier, more efficient operation. By reducing the number of separate components that must be manufactured and stocked, and the number of different, fully assembled products that must be stored, economies can be realized in manufacturing and distributing.

These improvements result in a more efficient and less expensive means for cutting bolts and similar products. An appreciation of the other aims and objectives of the present invention and an understanding of it may be achieved by referring to the accompanying drawings and description of a preferred embodiment.

DETAILED DESCRIPTION OF THE PREFERRED EMBODIMENT

Figure 1:
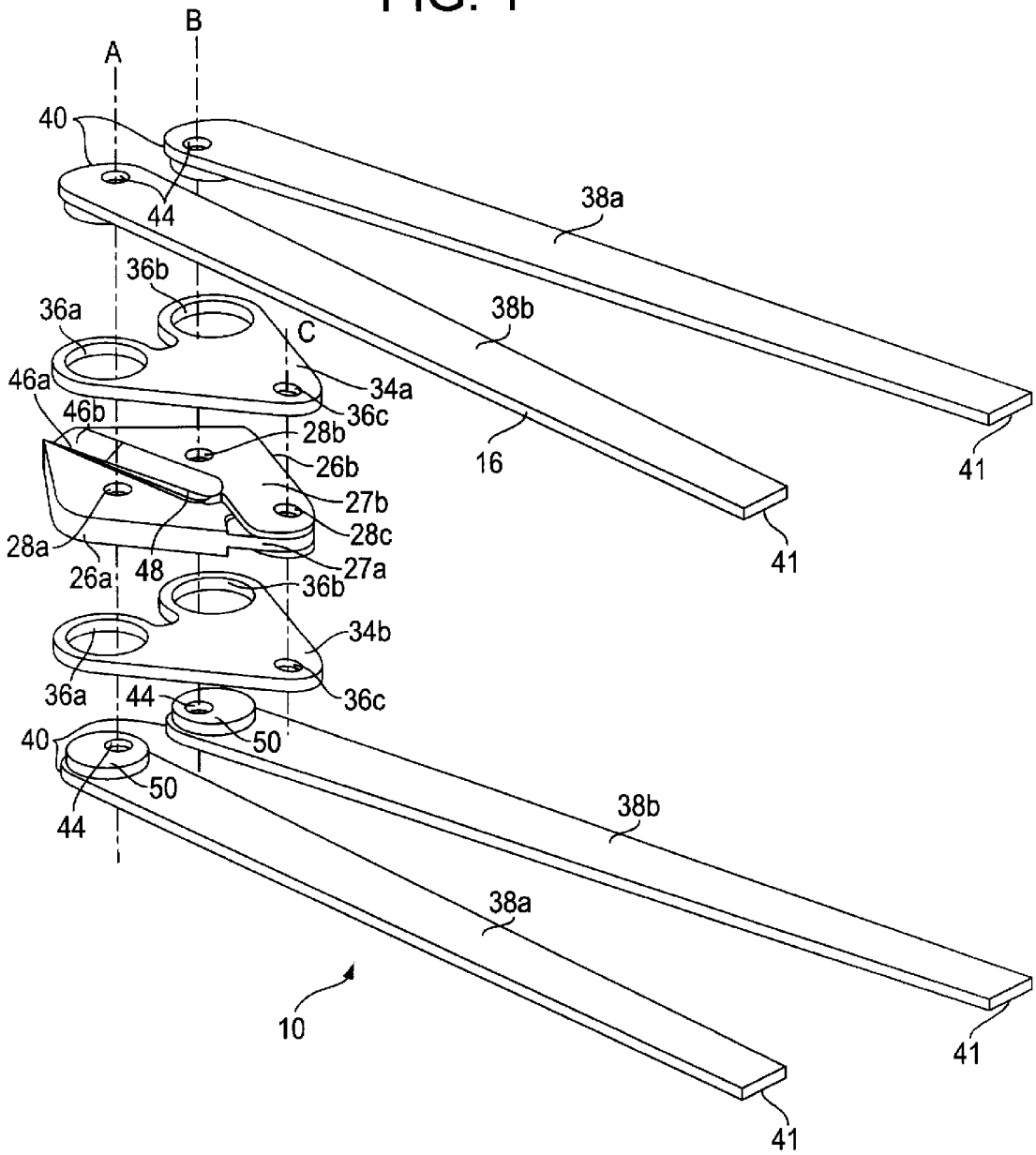
FIG. 1 is an isometric, exploded view of the cutter in the closed position.

FIG. 1 shows an isometric exploded view of the cutter 10 in the closed position. The cutting mechanism is comprised of left and right cutting jaws 26*a*, 26*b* which are generally triangular in shape. Cutting edges 46*a*, 46*b* are formed on the inner, opposing edge of each cuttingjaw 26*a*, 26*b*. The cutting edges 46*a*, 46*b* may be curved or have compound angles as will be further explained below. Each cutting jaw 26*a*, 26*b* has a center hole 28*a*, 28*b* located adjacent to the cutting edges 46*a*, 46*b* and a pivot hole 28*c* located at the base 27*a*, 27*b* of each cutting jaw 26*a*, 26*b*. The bases 27*a*, 27*b* of the cutting jaws 26*a*, 26*b* are in the form of a mating clevis and step so the cutting jaws 26*a*, 26*b* can be mated together at the base 27*a*, 27*b* allowing rotation about the pivot hole 28*c*. The cutting edges are formed so that there is an opening 48 between the them when the cutter 10 is closed, which facilitates cutting of the inserted material.

Two, generally triangular straps 34*a*, 34*b* are placed above and below the cutting jaws 26*a*, 26*b* to guide the cutting jaws 26*a*, 26*b*. Each strap 34*a*, 34*b* includes a left mounting hole 36*a* which is larger than and eccentrically aligned with the left cutting jaw center hole 28*a* along the A-axis. Similarly, each strap 34*a*, 34*b* includes a right mounting hole 36*b* which is larger than and eccentrically aligned with the right cutting jaw center hole 28*b* along the B-axis. Each strap 34*a*, 34*b* also has an elongated base hole 36*c* which is aligned with the cutting jaw pivot hole 28*c* along the C-axis. The two straps 34*a*, 34*b* are identical. Alternatively, a single strap 34*a*, placed either above or below the cutting jaws 26*a*, 26*b*, may be used as a guiding means. As another alternative, the two straps 34*a*, 34*b* may be joined together as an assembly by welding, casting or other means. Use of such an assembly would increase the stiffness of the invention 10.

Two elongated top handle plates 38*a*, 38*b* are located above the top strap 34*a*. Similarly, two elongated bottom handle plates 38*b*, 38*a* are located below the bottom strap 34*b*. All handle plates 38*a*, 38*b* have sides 16, a connecting end 40 and a gripping end 41. In the preferred embodiment, each handle plate 38*a*, 38*b* has an integral boss 50 located at the connecting end 40 and each boss 50 has an eccentric hole 44 which penetrates both the boss 50 and the plate 38*a*, 38*b*. Each hole 44 is made to align with the left and right center holes 28*a*, 28*b* along the A-axis and B-axis, respectively. Each boss 50 is made to mate with the respective mounting holes 36*a*, 36*b* on the straps 34*a*, 34*b*. In the single strap version of this invention 10, mentioned above, bosses 50 are only needed on one set of plates 38. Whether these are called the top plates 38*a*, 38*b* or the bottom plates 38*b*, 38*a* is immaterial.

The handle plates 38*a*, 38*b* are mirror images of each other and the top handle plates 38*a*, 38*b* are identical to the bottom handle plates 38*b*, 38*a* except in the reversed position. The handle bosses 50 may be formed as depressions in the handle plates 38*a*, 38*b*, or formed integral with the handle plates 38*a*, 38*b*, or be joined to the handle plates 38*a*, 38*b* by adhesive bonding, welding, or by other similar means.

Figure 2:
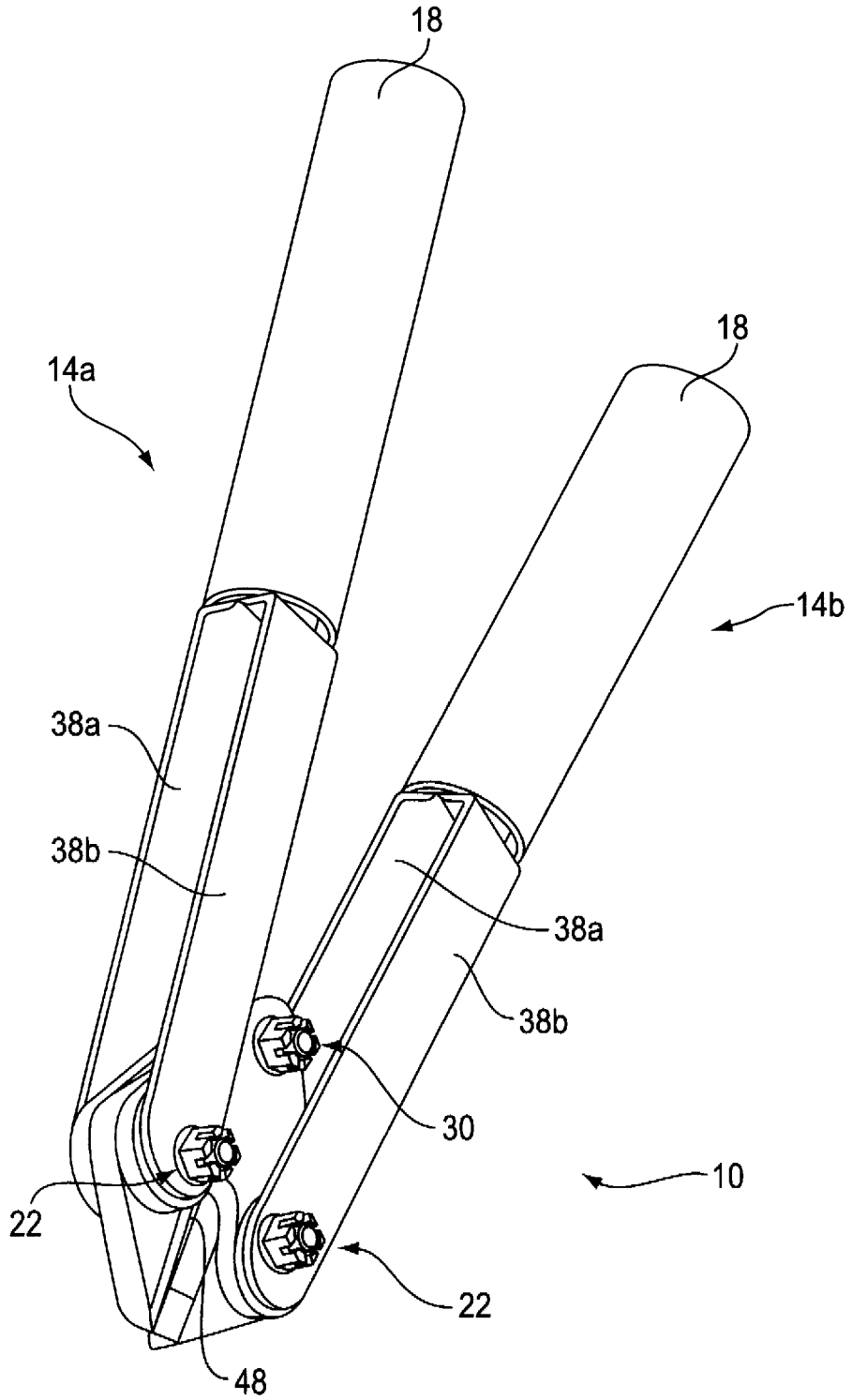
FIG. 2 is an isometric view with the cutter in the closed position.

FIG. 2 shows an isometric view of the closed cutter 10 as it appears when fully assembled. The cutting jaws 26*a*, 26*b*, the straps 34*a*, 34*b*, and the handle plates 38*a*, 38*b* are held together along the A and B-axes by two front hardware units 22. The two front hardware units 22 are each comprised of a nut, bolt, and washers. Alternatively, the front hardware units 22 can be comprised of a fastener inserted through one hole 44 of a one handle plate 38*a*, which is not threaded, and tightened at the opposing hole 44, which is threaded.

The jaws 26*a*, 26*b* are rotatably held together by a rear hardware unit 30 along the C-axis. The rear hardware unit 30 is also comprised of a nut, bolt, and washers. The heads of the nut and bolt may be made small so as to fit within the elongated holes 36*c*, 36*c*. FIG. 2 also illustrates the opening 48 formed between the curved cutting edges 46*a* 46*b* when the cutter 10 is closed, which facilitates the cutting of the inserted material.

The assembly of the top handle plates 38*a* and the bottom handle plates 38*b* results in the formation of the left and right handles 14*a*, 14*b*. A grip 18 is inserted over the gripping end 41 of each handle 14*a*, 14*b* which provides a gripping means and assists in keeping the handle plates 14*a*, 14*b* together.

FIG. 2 illustrates one method of making rigid handles 14*a*, 14*b* for the invention 10. In this method, the plates 38*a*, 38*b* are formed at their grip ends 41 so that the plates 38*a*, 38*b* are in intimate contact at their grip ends 41 only. The grips 18 are then slid over the mating sections of the plates 38*a*, 38*b*. Alternatively, the gap at the grip ends 41 could be filled by a separate filler strips or formation of an integral filler in the grips 18.

Another method of making rigid handles 14*a*, 14*b* is to form the plates 38*a*, 38*b* along their sides 16 so that the plates 38*a*, 38*b* are in intimate contact along most of their length. Yet another method of making rigid handles 14*a*, 14*b* is to joint the pairs of plates 38*a*, 38*b* on each side of the invention 10 to form assemblies. Such assemblies can be made by welding, casting or other methods. Such assemblies can only be utilized with the separate bosses 50, described below.

Figure 3:
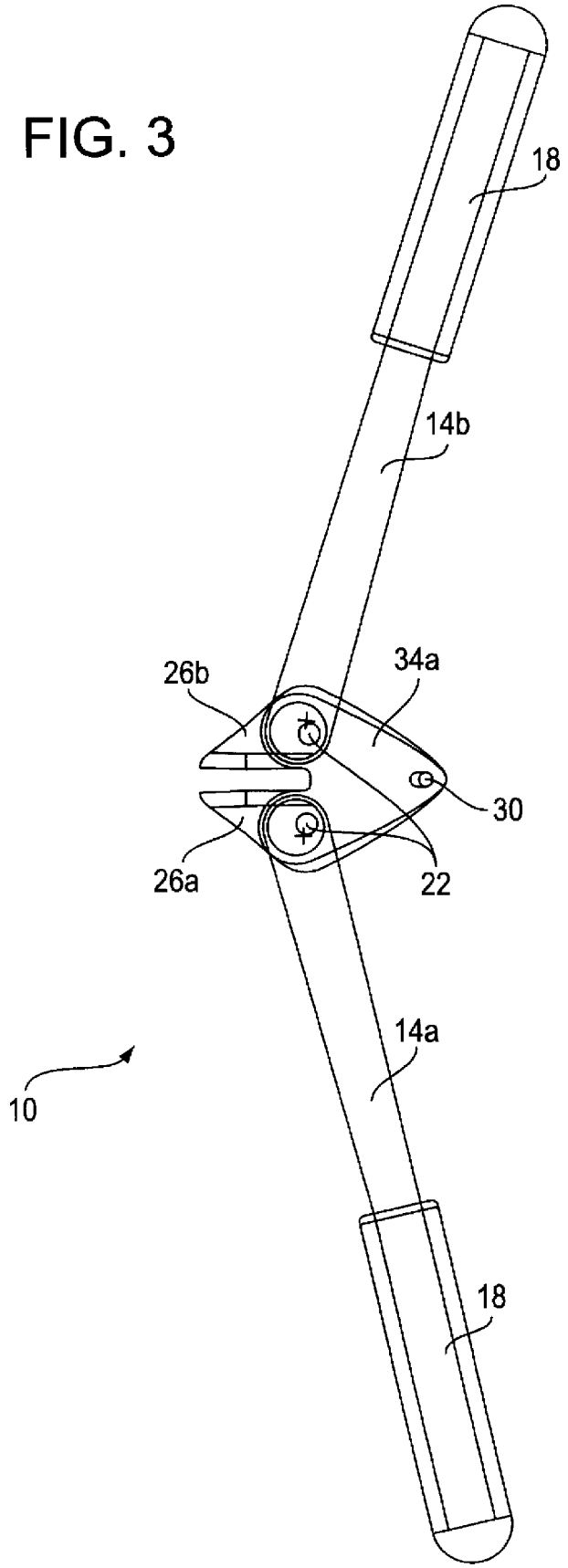
FIG. 3 is a top view of the cutter in the open position.

FIG. 3 is a top view of the cutter 10 in the open position. Separation of the handles 14*a*, 14*b* results in the opening of the cutting jaws 26*a*, 26*b* which allows for insertion of the material to be cut between the jaws 26*a*, 26*b*. Bringing the handles 14*a*, 14*b* together results in the cutting jaws 26*a*, 26*b* closing thereby providing cutting force. The unique design of the present invention allows cutting force to be applied over most of the motion range of the handles 14*a*, 14*b* resulting in easier operation. One or more straps 34*a*, 34*b* serve to guide the linear motion of the jaws 26*a*, 26*b*.

Figure 4:
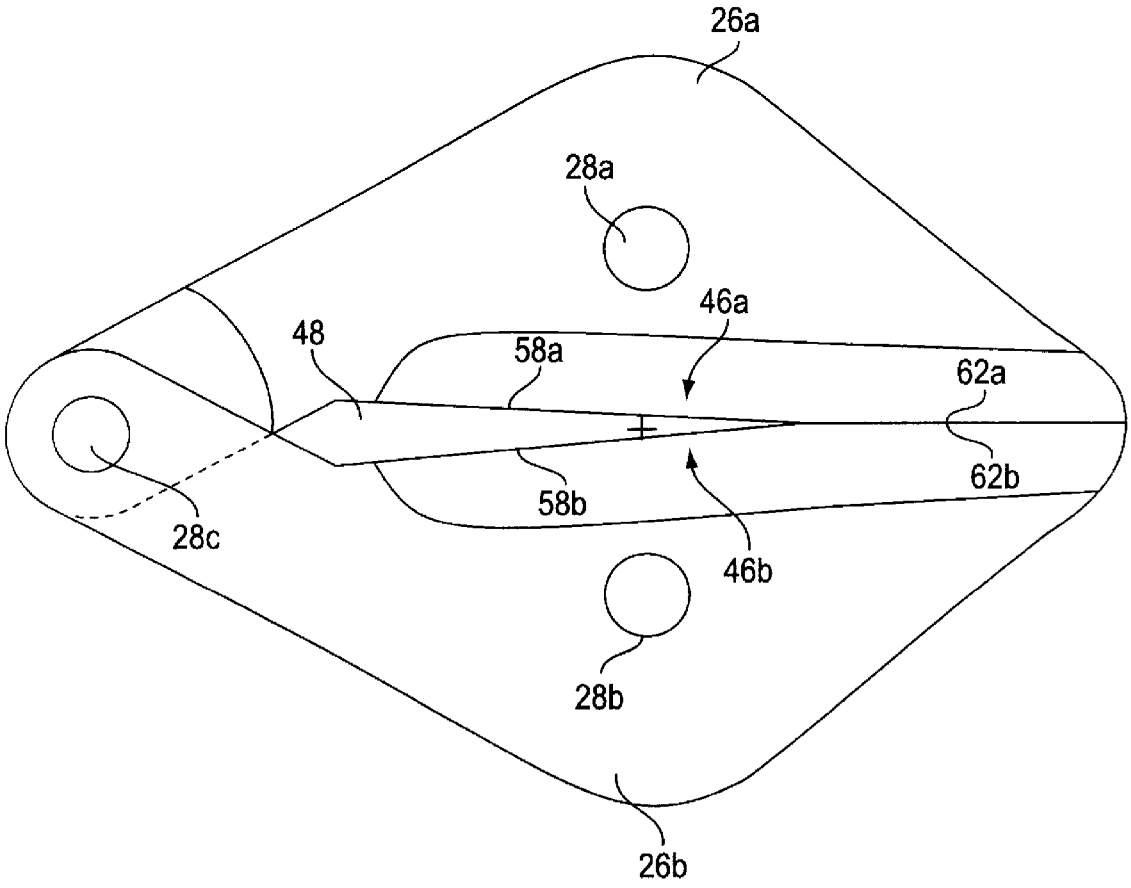
FIG. 4 is a top view an alternate design for the jaws in the closed position.

FIG. 4 shows a top view of the alternative jaws 26*a*, 26*b* in the closed position. In this alternative design, the cutting edges 46*a*, 46*b* are made up of two straight sections 58*a*, 58*b*, 62*a*, 62*b*. The fore sections 62*a*, 62*b* are designed to mate while the raked rear sections 58*a*, 58*b* are designed to leave a gap 48 when the cutting jaws 26*a*, 26*b* are closed.

Figure 5:
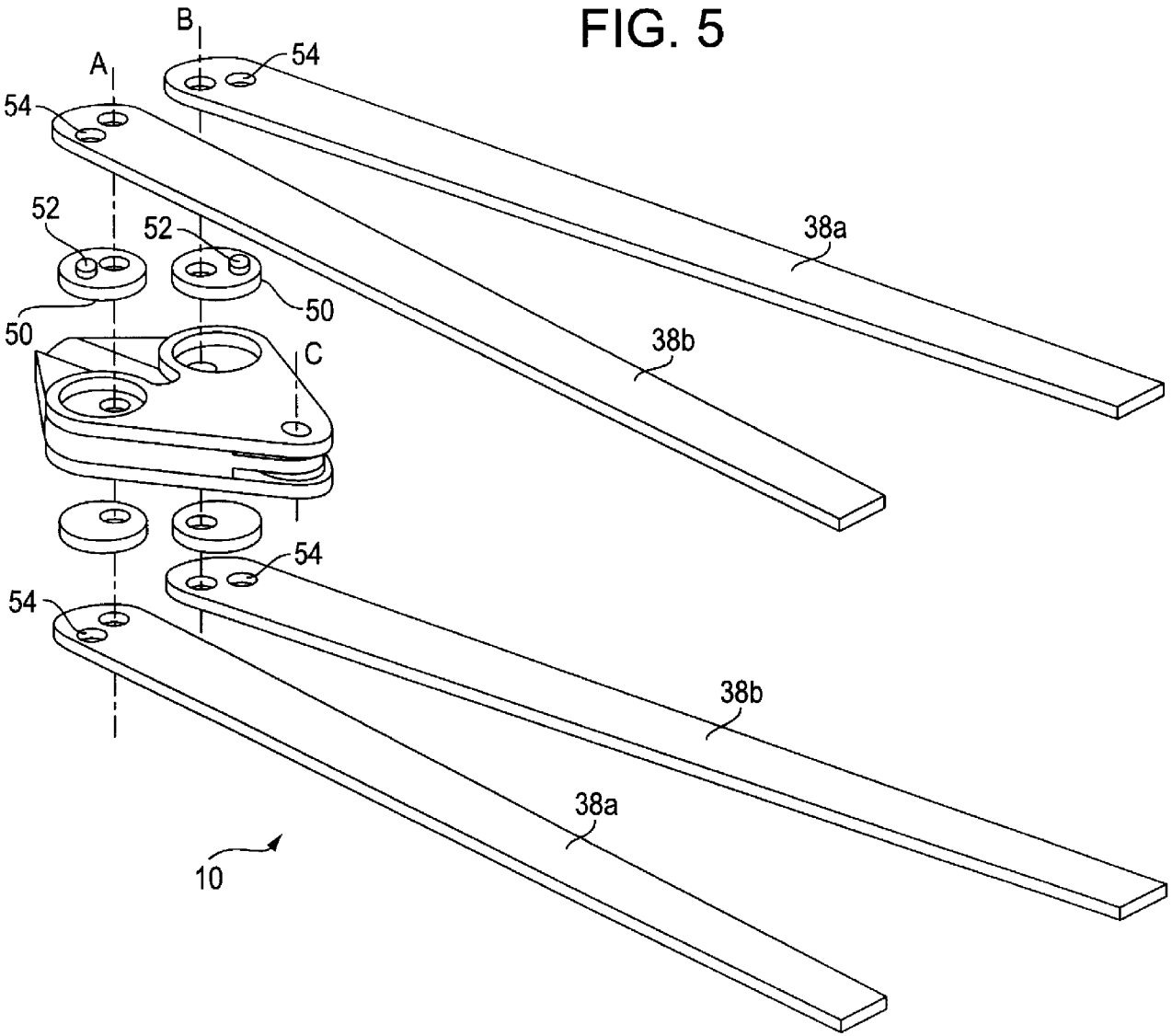
FIG. 5 is an isometric, exploded view of an alternative embodiment of the cutter showing separate handle bosses.

FIG. 5 shows an isometric, exploded view of an alternative embodiment of the cutter 10 with separate handle bosses 50. In this embodiment, each handle boss 50 has a small protrusion 52 and each handle plate 38*a*, 38*b* has a small anti-rotation hole 54. Thus, when the bolt cutter 10 is fully assembled, the bosses 50 will not rotate. The protrusions 52 and their mating holes 54 can be circular, as shown on FIG. 5, or rectangular. The handle plates 38*a*, 38*b* and the separate handle bosses 50 of this embodiment are separate component parts thereby rendering this alternative embodiment easier to manufacture.

The reference numerals shown on FIGS. 1–5 are summarized below.

10 cutter
14*a* left handle formed of separate plates
14*b* right handle formed of separate plates
16 side of handle
18 grips
22 front hardware units
26*a* left cutting jaw
26*b* right cutting jaw
27*a* base of right cutting jaw
27*b* base of left cutting jaw
28*a* left center hole
28*b* right center hole
28*c* pivot hole
30 rear hardware unit
34*a* top strap
34*b* bottom strap
36*a* left mounting hole

36*b* right mounting hole
36*c* base hole
38*a* top handle plate
38*b* bottom handle plate
40 connecting end of handle plate
41 gripping end of handle plate
44 eccentric hole
46*a* curved cutting edge of left jaw
46*b* curved cutting edge of right jaw
48 radial opening
50 handle boss
52 small protrusion
54 anti-rotation hole
58*a* a rear section of left cutting edge
58*b* rear section of right cutting edge
62*a* fore section of left cutting edge
62*b* rear section of right cutting edge In the reference numerals, suffixes "a" and "b" have sometimes been used to designate right and left hand, and upper and lower components. For convenience in description, right and left hand, and upper and lower components have also been referenced above. However, it will be appreciated by those who are familiar with the art to which this invention pertains, that this invention 10 is essentially symmetrical from top to bottom, and is mirrored along its longitudinal axis so that the designations right, left, top and bottom can easily be interchanged or eliminated without affecting the invention 10.

The super bolt cutter 10 has been described with reference to two particular embodiments. Other modifications and enhancements can be made without departing from the spirit and scope of the claims that follow.

What is claimed is:

1. A cutting apparatus comprising:

a set of left and right cutting jaws each having an outer edge and an opposing, sharp inner edge with a center hole located between said outer edge and said sharp inner edge, a base, and a pivot hole located at said base; said set of left and right cutting jaws being mated together to allow rotation from an open to a closed position about said pivot hole; said sharp inner edges being designed so that when said left and right cutting jaws are in said closed position there is an opening near said base; said set of left and right cutting jaws having a top plane surface and a bottom plane surface;

a rear hardware unit which connects said set of left and right cutting jaws together in a manner which allows rotation about said pivot hole;

a top strap adjacent to said top plane surface;

a bottom strap adjacent to said bottom plane surface;

each of said straps being of roughly triangular shape, and having two mounting holes and a base hole; said mounting holes being larger than and positioned eccentrically in line with said center holes; said base holes being positioned in line with said pivot hole;

two elongated top plates adjacent to said top strap; each of said top plates having a gripping end, a connecting end and a top hole at said connecting end; said top holes being aligned with said center holes;

two elongated bottom plates adjacent to said bottom strap; each of said bottom plates having a gripping end, a connecting end and a bottom hole at said connecting end; said bottom holes being aligned with said center holes;

a circular boss on each of said connecting ends; each of said circular bosses having an eccentric hole and being mated through said mounting holes to a position adjacent to said plane surfaces; said eccentric holes being aligned with said center holes;

a pair of grips positioned at the gripping end of said plates facilitating gripping and further providing a means for joining said top plates to said bottom plates; and a pair of front hardware units connecting said top plates to said bottom plates through said top holes, said eccentric holes, said center holes and said bottom holes;

whereby juxtaposition of said top plates with said bottom plates creates an elongated pair of left and right handles manually moveable toward and away from one another; and whereby separation of said pair of left and right handles causes separation of said left and right jaws, and compression of said pair of left and right handles results in compression of said left and right jaws causing solid material placed between the jaws to be cut.

2. The cutting apparatus in claim 1, in which said base of said left and right cutting jaws is shaped as a mating clevis and step.

3. The cutting apparatus of claim 1, in which said rear hardware unit is comprised of a nut, a bolt, and a washer.

4. The cutting apparatus of claim 1, in which each of said front hardware units is comprised of a nut, a bolt, and a washer.

5. The cutting apparatus in claim 1, in which said top holes are threaded and each of said front hardware units comprises a threaded bolt.

6. The cutting apparatus in claim 1, in which said bottom holes are threaded and each of said front hardware units comprises a threaded bolt.

7. The cutting apparatus of claim 1, in which said circular bosses are integral with said top plates and said bottom plates.

8. The cutting apparatus of claim 1, in which said circular bosses are fastened to said top plates and said bottom plates.

9. The cutting apparatus of claim 1, in which each of said circular bosses further includes a means for preventing rotation.

10. The cutting apparatus of claim 9, in which said juxtaposed top plates and said juxtaposed bottom plates are connected together in a parallel, spaced apart relationship.

11. The cutting apparatus of claim 1, in which said top strap and said bottom strap are connected together in a parallel, spaced apart relationship.

12. A cutting apparatus comprising:

a set of left and right cutting jaws each having an outer edge and an opposing, sharp inner edge with a center hole located between said outer edge and said sharp inner edge, a base, and a pivot hole located at said base; said set of left and right cutting jaws being mated together to allow rotation from an open to a closed position about said pivot hole; said sharp inner edges being designed so that when said left and right cutting jaws are in said closed position there is radial opening near said base; said set of left and right cutting jaws having a top plane surface and a bottom plane surface;

a rear hardware unit which connects said set of left and right cutting jaws together in a manner which allows rotation about said pivot hole;

a top strap, of roughly triangular shape, having two mounting holes and a base hole; said top strap being placed adjacent to said top plane surface; said two mounting holes being larger than and positioned eccentrically in line with said center holes; said base hole being positioned in line with said pivot hole;

a set of two elongated top plates adjacent to said top strap; each of said top plates having a gripping end, a connecting end and a top hole at said connecting end; said top holes being aligned with said center holes;

a circular boss on each of said connecting ends; each of said circular bosses having an eccentric hole and being mated through said mounting holes to a position adjacent to said top plane surface; said eccentric holes being aligned with said center holes;

a set of two elongated bottom plates; each of said bottom plates having a gripping end, and a connecting end; said connecting end having a bottom hole and being placed adjacent to said bottom plane surface; said bottom holes being aligned with said center holes;

a pair of grips positioned at the gripping end of said top and bottom plates facilitating gripping and further providing a means for joining said top plates to said bottom plates; and a pair of front hardware units connecting said top plates to said bottom plates through said top holes, said eccentric holes, said center holes and said bottom holes;

whereby juxtaposition of said top plates with said bottom plates creates an elongated pair of left and right handles manually moveable toward and away from one another; and whereby separation of said pair of left and right handles causes separation of said left and right jaws, and compression of said pair of left and right handles results in compression of said left and right jaws causing solid material placed between the jaws to be cut.

13. The cutting apparatus in claim 12, in which said base of said left and right cutting jaws is shaped as a mating clevis and step.

14. The cutting apparatus of claim 12, in which said rear hardware unit is comprised of a nut, a bolt, and a washer.

15. The cutting apparatus of claim 12, in which said front hardware unit is comprised of a nut, a bolt, and a washer.

16. The cutting apparatus in claim 12, in which said top holes are threaded and each of said front hardware units comprises a threaded bolt.

17. The cutting apparatus in claim 12, in which said bottom holes are threaded and each of said front hardware units comprises a threaded bolt.

18. The cutting apparatus of claim 12, in which said circular bosses are integral with said top plates.

19. The cutting apparatus of claim 18, in which said juxtaposed top plates and said juxtaposed bottom plates are connected together in a parallel, spaced apart relationship.

20. The cutting apparatus of claim 12, in which said circular bosses are fastened to said top plates.

21. The cutting apparatus in claim 12, in which each of said circular bosses further includes a means for preventing rotation.

* * * * *